United States Patent [19]

Van Zon et al.

[11] 4,383,200

[45] May 10, 1983

[54] LOW-PRESSURE MERCURY VAPOR DISCHARGE LAMP

[75] Inventors: Adrianus J. H. J. Van Zon, Eindhoven; Johannes R. Gelens, Terneuzen, both of Netherlands

[73] Assignee: U.S. Philips Corporation, New York, N.Y.

[21] Appl. No.: 238,321

[22] Filed: Feb. 26, 1981

[30] Foreign Application Priority Data

Mar. 28, 1980 [NL] Netherlands ..... 8001833

[51] Int. Cl.[3] ..... H05B 41/16

[52] U.S. Cl. ..... 315/57; 313/634; 315/50; 315/58; 315/62; 315/112

[58] Field of Search ..... 315/50, 57, 58, 62, 315/70, 71, 112, DIG. 5; 313/17, 161, 204, 493

[56] References Cited

U.S. PATENT DOCUMENTS 4,270,071 5/1981 Morton ..... 315/62

4,300,073 11/1981 Skwirut et al. ..... 315/50 X

*Primary Examiner*—Eugene R. La Roche

*Attorney, Agent, or Firm*—Robert S. Smith

[57] ABSTRACT

Low-pressure mercury vapor discharge lamp comprising a, preferably folded, discharge tube located within a lamp envelope and having electrodes and an electric stabilization ballast, which is partly surrounded by a thin-walled lamp base, which is connected to the envelope.

In the region of the connection between the lamp base and the lamp envelope there is a metal plate for cooling the ballast, this heat sink being at the same time a mounting plate for further components in the lamp such as a starter switch.

9 Claims, 1 Drawing Figure

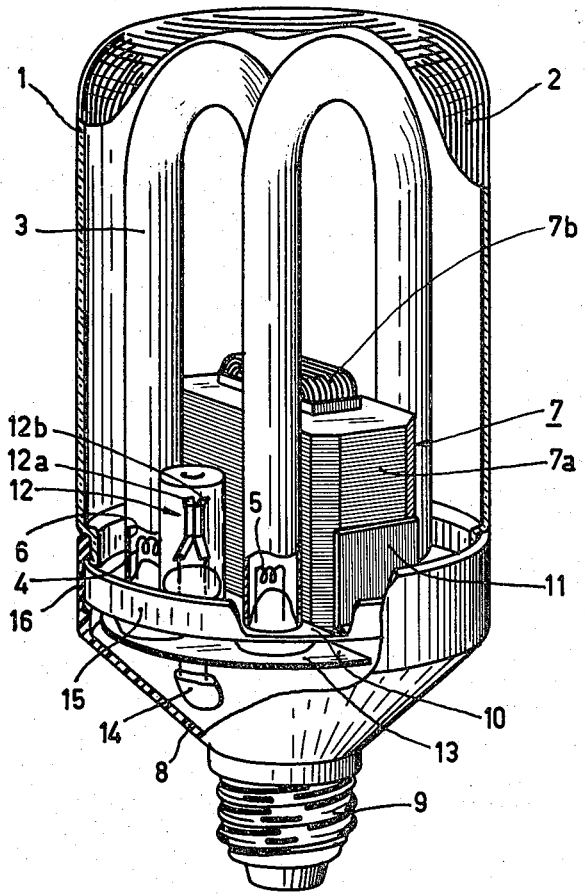
1
2
3
7b
7
7a
12b
12a
12
5
6
4
16
11
15
14
10
13
8
9

LOW-PRESSURE MERCURY VAPOR DISCHARGE LAMP

The invention relates to a low-pressure mercury vapor discharge lamp including a lamp envelope discharge tube therein which is closed in a vacuum-tight manner and contains mercury and a rare gas, electrodes between which a discharge takes place during operation being arranged one at each end of the discharge tube, an electric stabilization ballast for the discharge, and a hollow lamp base which is connected to the envelope and has a lamp cap for fitting the lamp in a luminaire. Such a lamp is disclosed in United Kingdom Patent Application Ser. No. 2003314.

The lamp described in the said patent application has a discharge tube of such a shape that, despite having a comparatively long discharge path between the electrodes, the lamp is nevertheless suitable for use as an alternative for an incandescent lamp for general lighting purposes.

In the known lamp the electric stabilization ballast, which is connected in series with the lamp and which is necessary for the operation of the lamp, is included in a hollow, cylindrical lamp base of, for example, a synthetic material. One end of the lamp base is connected to the lamp envelope (for example by means of a clamp connection), the other end being of somewhat conical shape and having there, for example, an edison lamp cap, by means of which the lamp can be fixed in a luminaire. For this lamp there is the risk during operation that, owing to the heat generated by the ballast, the temperature of the ballast increases to such a high value, that the insulating material around the wire of the induction coil which forms part of the ballast is easily attacked. In addition, there is the risk that the wall of the lamp base is deformed by the heat. The chance the lamp base detaches from the lamp envelope is then not inconceivable. Furthermore, when comparatively much heat is developed in the ballast, it is possible that the vapor pressure in the discharge tube may increase to such a value that the critical mercury vapor pressure (approximately $6\times10^{-3}$ torr) for optimum conversion of the electric power into ultraviolet radiation may be exceeded. This causes the efficiency of the lamp to decrease. This disadvantage exists particularly for those lamps of which at least a portion of the lamp base wall or the ballast itself is arranged in the immediate vicinity of the discharge tube. As furthermore the discharge tube is surrounded by an envelope, the temperature in the tube may increase to a value which is too high to ensure the most advantageous efficiency.

It is an object of the invention to provide a low-pressure vapor discharge lamp of the type defined in the opening paragraph, which can be fabricated in a simple manner, the influence of the heat generated by the electric ballast and by other components of the lamp being as low as possible.

According to the invention, a low-pressure mercury vapor discharge lamp of the type defined in the opening paragraph is characterized in that at least the electric stabilization ballast and the ends of the discharge tube are connected to a metal plate which extends across the lamp base in the region of the connection of the lamp base to the lamp envelope.

The metal plate extends to, for example, the wall of the lamp base or the lamp envelope and bears there against the lamp base or against the envelope.

In a lamp in accordance with the invention, the heat generated by the ballast during operation is rapidly dissipated to the exterior of the lamp by the metal plate (which has a high coefficient of heat conduction). In a lamp in accordance with the invention the influence of the heat generated by the ballast on itself and on the remaining components of the lamp, such as the starter, the discharge tube, the electric leads and the lamp base, is as low as possible.

In a lamp in accordance with the invention no special openings in the lamp base or in the envelope are necessary to keep the ballast at a relatively low temperature. In the discharge tube the vapor pressure stabilizes at a value which is substantially that for the optimum conversion efficiency mentioned above.

In one embodiment of the lamp according to the invention the metal plate not only functions as a heat-sink but also as a support for the discharge tube, the stabilization ballast, the starter, the lamp envelope, and the electric circuitry which is provided on, for example, a synthetic material plate connected to the metal plate. By concentrating the connecting points of the said electrical components in this manner, manufacture of the lamp is facilitated. The discharge tube, the envelope, and the starter may be connected to the metal plate, for example by means of a suitable adhesive or by means of a screw, clamp, or snap connection. In a practical embodiment the discharge tube is connected to the metal plate by means of a clamp spring which cooperates with an upright edge of the metal plate. The spring then provides a clamp connection of the discharge tube to the said edge.

In a second embodiment of a lamp according to the invention the metal plate has upright walls which are in intimate contact with one or more walls of the ballast. The ballast is positioned on the plate by means of walls in the form of fins. Furthermore, a proper heat discharge is ensured.

In another embodiment the metal plate has upright walls which, in cross-section, form a rectangular pipe, in which the stabilization ballast is included with at least a clamp fit. The pipe and the plate are, for example, fabricated from a single sheet of metal.

In a further embodiment of a lamp in accordance with the invention, the upright walls have means for connecting the discharge tube thereto. Then it is not necessary to provide special openings in the metal plate in which the discharge tube is secured by means of an adhesive or plaster of Paris. The said means may, for example, be brackets connected to the upright walls of the metal plate.

Preferably, the metal plate is provided, at least on a portion of its circumference, with raised edge which engages the outside of the lamp envelope wall, which edge may be surrounded with a clamp fit by the wall of the lamp base. The metal plate then serves as a coupling element for the lamp base and the lamp envelope.

In yet another embodiment of a lamp in accordance with the invention, that side of the metal plate which faces the discharge tube is coated with a reflecting material, such as titanium dioxide. The luminous flux of the lamp is then increased. Preferably, the metal plate consists of aluminium.

The electric stabilization ballast may be connected to the metal plate by means of, for example, spot welding or a clamp or a screw connection. It is alternatively possible, however, for the metal plate to be formed by one of the laminations of the ballast itself. The ballast may comprise an assembly of V and T laminations with an electric coil arranged in the windows thereof. This embodiment has the advantage that no extra connections between the metal plate and the ballast are necessary.

In a lamp in accordance with the invention, the discharge tube is preferably folded in one or more places in order to ensure that a relatively high arc voltage is attainable in the discharge tube in as small a lamp volume as possible. The discharge tube is folded, for example, a number of times until it has the shape of a hook.

The invention will now be further explained with reference to the accompanying drawing which shows an embodiment of a low-pressure mercury vapor discharge lamp according to the invention.

The lamp comprises a glass, cylindrical lamp envelope 1, which is closed at one end. The outside of this envelope has a ripple pattern 2, so that a uniform brightness of the lamp is obtained. Within this envelope 1 there is a discharge tube 3 which is closed in a vacuum-tight manner and which is folded three times to form a hook. Electrodes 4 and 5, between which a discharge takes place during operation of the lamp, are arranged one at each end of the tube. A luminescent layer 6, which converts the ultra-violet radiation generated in the discharge into visible light, is present on the inside of the discharge tube wall. Furthermore, the lamp includes an electric stabilization ballast 7 (for example an assembly *7a* of V and T laminations and a coil *7b*) and a hollow synthetic material lamp base 8. One end of this lamp base is connected to the lamp envelope and the other end has a generally conical shape and is provided with an edison screw lamp cap 9, by means of which the lamp can be screwed into an incandescent lamp luminaire. Near the connection of the lamp base to the envelope there is a circular, aluminium plate 10, which extends substantially to the outside of the lamp to dissipate the heat generated by the ballast. The plate has two upright walls 11 (only one of which is shown in the drawing), which are rigidly connected to the walls of the ballast, for example by welding. The ballast is so positioned on plate 10 that a portion thereof is surrounded by the lamp envelope and another (smaller) portion by the wall of the lamp base. As a result thereof the overall length of the lamp is comparatively small. The plate is also provided with openings to accommodate the ends of the discharge tube 3. The tube is fastened in the plate by means of an adhesive. In addition, the plate is provided with an opening to accommodate a glow starter switch 12. This starter switch comprises two bimetal strips 12*a* and 12*b*, which are substantially of the same length. These bimetal strips are so oriented that they bend towards each other on an increase in the temperature. The cross-section of one bimetal strip is considerably smaller than that of the other bimetal strip. This achieves that the bimetal strips touch each other during the starting procedure, which promotes ignition of the discharge tube 3; but during the operating condition of the discharge tube and the then relatively high temperature of the glow starter switch the bimetal strips are not in contact with one another. This glow starter comprises feed-through elements for the bimetal strips. These feed-through elements consist of a chromium-iron nickel alloy.

A thin plate 13 of synthetic material is connected to that side of the metal plate 10 which faces the lamp base. By means of plate 13 the supply wires for the electrodes, the starter and the capacitor 14 associated with this starter, are interconnected by means of piercing connections. In addition, the supply wire of a thermoprotector 14 connected to the sleeve 9 is connected to plate 13, which is electrically isolated from the metal plate 10.

On a portion of its circumference, the metal plate 10 has a raised edge 15 which engages the envelope 1. The edge 15 is itself surrounded clampingly by wall portions (such as 16) of the lamp base. Thus the metal plate not only functions as heat sink and a mounting plate, but also serves as a coupling element between the lamp base and the envelope.

In a practical embodiment of the above-described lamp the overall length of the discharge tube 3 was approximately 36 cm; the inside diameter was approximately 10 mm. The metal plate had a diameter of approximately 6.5 cm and a thickness of approximately 0.8 mm. The height of the ballast 7 was approximately 3.5 cm, the width approximately 2.5 cm and the depth 4 cm. The luminous flux of the lamp was 900 lm, a quantity of mercury and argon (3 torr) being present in the discharge tube and the inside of the wall being coated with a luminescent layer consisting of a mixture of two phosphors, namely green luminescing, terbium-activated cerium magnesium aluminate and red luminescing, trivalent europium-activate yttrium oxide. The power consumed by the lamp (inclusive of the ballast) was 18 W (200 V, AC).

What is claimed is:

1. A low-pressure mercury vapor discharge lamp including a lamp envelope member, a discharge tube therein which is closed in a vacuum-tight manner and contains mercury and a rare gas, electrodes between which a discharge takes place during operation being arranged one at each end of the discharge tube, an electric stabilization ballast for the discharge, and a hollow lamp base member which is connected to the envelope member and a lampcap member for fitting the lamp in a luminaire, and a metal plate, at least the electric stabilization ballast and the ends of the discharge tube being connected to the metal plate, the metal plate being arranged near the connection of the lamp base member to the lamp envelope member and extends to one of said members, the metal plate having upright walls with which one or more walls of the ballast are in intimate thermal contact.

2. A low-pressure mercury vapor discharge lamp as claimed in claim 1, wherein there are four upstanding walls closely surrounding the ballast.

3. A low-pressure mercury vapor discharge lamp as claimed in claim 1 or 2, wherein the upright walls have means for connecting the discharge tube thereto.

4. A low-pressure mercury vapor discharge lamp as claimed in claim 1 or 3, wherein the metal plate has on at least a portion of its circumference a raised edge which engages the outside of the lamp envelope member and the lamp base member engagingly clamps the envelope member around said edge.

5. A low-pressure mercury vapor discharge lamp as claimed in claim 1 or 3 wherein a starter switch is arranged on the metal plate.

6. A low-pressure mercury vapor discharge lamp as claimed in claim 1 or 3, characterized in that the side of the metal plate facing the discharge tube is coated with reflecting material.

7. A low-pressure mercury vapor discharge lamp as claimed in claim 1 or 3, characterized in that the metal plate is made of aluminium.

8. A low-pressure mercury vapor discharge lamp as claimed in claim 1 or 3 wherein the ballast includes a plurality of laminations and the metal plate is constituted by at least one of the ballast laminations.

9. A low-pressure mercury vapor discharge lamp as claimed in claim 1 or 3 further including a clamp spring and the discharge tube is connected to the plate by means of the clamp spring which cooperates with an upright edge of the metal plate.

* * * * *